US007800881B2

(12) United States Patent
Benedetto

(10) Patent No.: US 7,800,881 B2
(45) Date of Patent: Sep. 21, 2010

(54) PROTECTIVE PLUG FOR A CONNECTION MODULE

(75) Inventor: Adrian Benedetto, Berlin (DE)

(73) Assignee: ADC GmbH, Berlin (DE)

( * ) Notice: Subject to any disclaimer, the term of this patent is extended or adjusted under 35 U.S.C. 154(b) by 31 days.

(21) Appl. No.: 12/065,577

(22) PCT Filed: Aug. 24, 2006

(86) PCT No.: PCT/EP2006/008299

§ 371 (c)(1),
(2), (4) Date: Mar. 3, 2008

(87) PCT Pub. No.: WO2007/028502

PCT Pub. Date: Mar. 15, 2007

(65) Prior Publication Data

US 2008/0247112 A1 Oct. 9, 2008

(30) Foreign Application Priority Data

Sep. 6, 2005 (DE) ..... 10 2005 042 163

(51) Int. Cl.
*H02H 3/22* (2006.01)

(52) U.S. Cl. ..... 361/117

(58) Field of Classification Search ..... 361/117, 361/40, 39, 111, 119, 124
See application file for complete search history.

(56) References Cited

U.S. PATENT DOCUMENTS

| | | | | |
|---|---|---|---|---|
| 4,607,135 | A | 8/1986 | Taybl et al. | |
| 5,157,580 | A * | 10/1992 | Hegner et al. | 361/119 |
| 6,416,349 | B1 * | 7/2002 | Lee | 439/404 |
| 7,270,551 | B2 | 9/2007 | Busse et al. | |
| 2003/0156389 | A1 * | 8/2003 | Busse et al. | 361/736 |
| 2007/0064373 | A1 | 3/2007 | Neumetzler et al. | |

FOREIGN PATENT DOCUMENTS

| | | |
|---|---|---|
| AU | 748833 | 11/1999 |
| DE | 3 306 263 | 8/1984 |
| DE | 3 348 151 | 6/1989 |
| DE | 39 09 783 | 10/1990 |
| DE | 40 30 804 | 4/1992 |
| DE | 198 16 907 | 4/1998 |
| DE | 100 29 649 | 1/2002 |
| DE | 103 17 621 | 11/2004 |

(Continued)

*Primary Examiner*—Stephen W Jackson
*Assistant Examiner*—Angela Brooks
(74) *Attorney, Agent, or Firm*—Merchant & Gould P.C.

(57) ABSTRACT

The invention relates to a protective plug (1) for a connection module (30), in particular in a terminal distribution box, comprising at least one surge arrester (5), a plastic housing (2), at least two connection contacts and at least one ground contact, it being possible, via the connection contacts, for the surge arrester (5) to be connected to connection contacts of a connection module (30), and it being possible, via the ground contact, for an electrical connection to be produced between the surge arrester (5) and a grounding rail (32) arranged below the connection module (30), the surge arrester (5) being arranged on a printed circuit board (4), the connection contacts being in the form of twin fork contacts (3), and the twin fork contacts (3) being formed with a stop (3*c*), which stops at a stop edge in the housing (2).

19 Claims, 2 Drawing Sheets

FOREIGN PATENT DOCUMENTS

Figure 1:
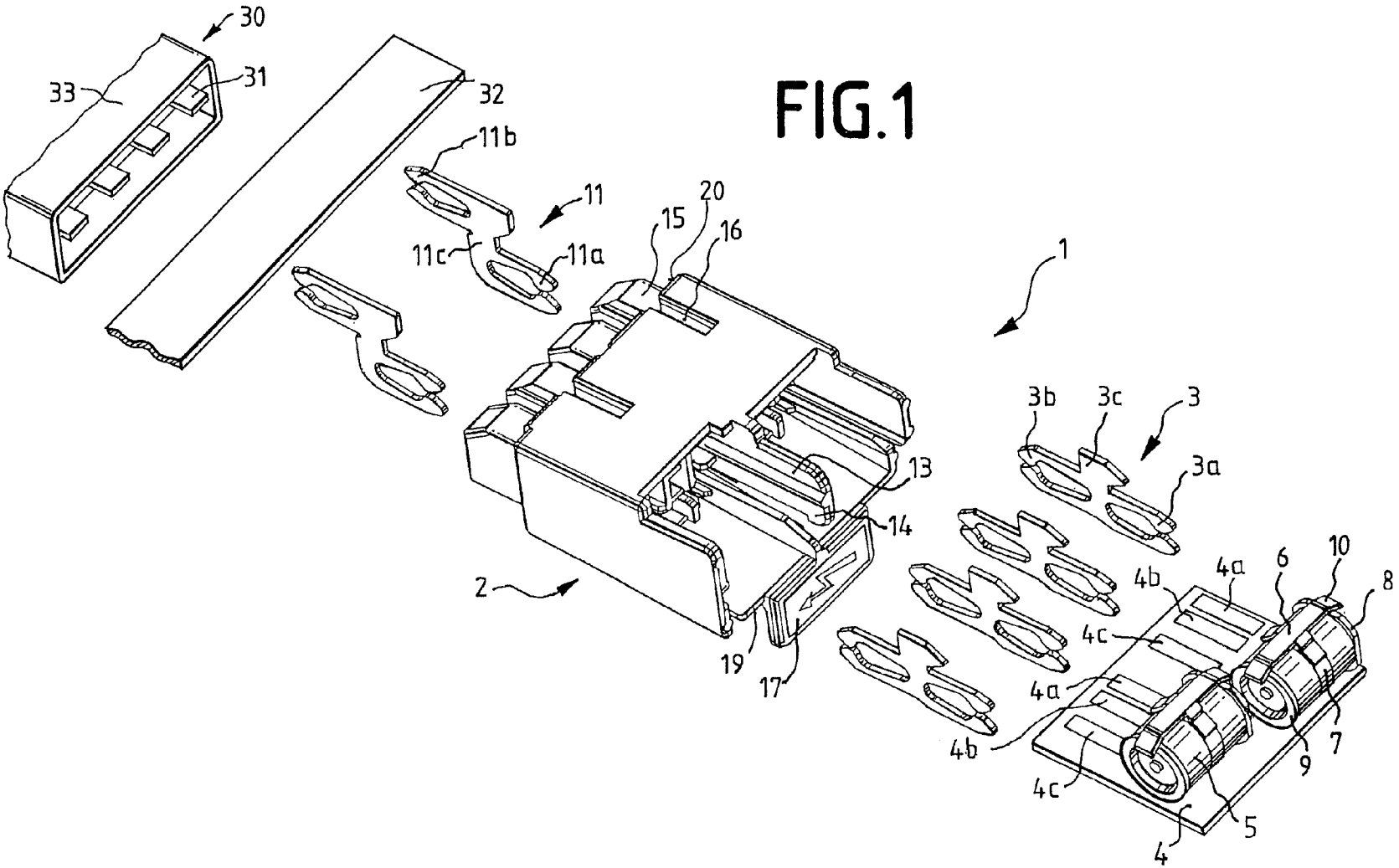

| | | |
|---|---|---|
| GB | 2 287 367 | 9/1995 |
| NZ | 522819 | 4/2004 |
| WO | WO 01/97332 | 12/2001 |
| WO | WO 01/97339 | 12/2001 |
| WO | WO 2004/093275 | 10/2004 |

* cited by examiner

PROTECTIVE PLUG FOR A CONNECTION MODULE

The invention relates to a protective plug for a connection module, in particular in a terminal distribution box.

Terminal distribution boxes or cable terminal distribution boxes typically represent the last connection point between the system side and the subscriber. Terminal distribution boxes are therefore arranged locally, even in the vicinity of the subscriber, for example on a house wall. A terminal distribution box typically comprises a housing, in which two or more connection modules are arranged, which are designed to connect twin wires. In this case, the contacts for the purpose of connecting the twin wires are preferably arranged in two parallel rows, the incoming system wires being connected to one row, and the outgoing twin wires to the subscriber being connected to the other row. It is known to use surge arresters for the purpose of limiting interference voltages owing to atmospheric discharges and short-term exposure to high-voltage currents. In order to loop-in the surge arresters, the connection modules have, for example, protruding contact springs, which are connected to the connection contacts of the connection module. In this case, typically two mutually opposing connection contacts are connected to one another. A protective plug or a protection magazine is plugged onto these contact springs. A protective plug is generally used when one twin wire is being protected, whereas a magazine is used to protect a plurality of twin wires at the same time. However, the term "protective plug" used below is intended also to include protecting a plurality of twin wires. These protective plugs have a corresponding number of two-pole surge arresters corresponding to the number of wires to be protected, the ground connections being connected to a grounding rail via a contact.

DE 33 06 263 C2 has disclosed a connection strip, in particular for a terminal distribution box in telecommunications engineering, having a generic protective plug.

Starting from such a prior art, the invention is based on the technical problem of providing a protective plug which has a simple design and by means of which a connection module having contact springs arranged can be protected against overvoltages.

For this purpose, the surge arrester is arranged on a printed circuit board, the connection contacts in the form of twin fork contacts being formed with a stop, which stops at a stop edge in the housing. This firstly makes it possible to replace defective surge arresters very simply and easily. Secondly, it is also easier to initially fit the protective plug since the surge arresters soldered onto the printed circuit board are inserted at the same time by inserting the printed circuit board. A further advantage is the fact that the fork contacts can compensate more effectively for the manufacturing tolerances of the contact springs. In order to produce the protective plug, initially the twin fork contacts are preferably inserted into the housing from the rear, the twin fork contacts abutting the stop edge with their stop. Subsequently, the printed circuit board is then inserted, as a result of which in each case one fork contact of the twin fork contact is pushed onto the printed circuit board and makes contact there with a conductor track leading to the surge arresters. The surge arresters are preferably in the form of three-pole surge arresters such that in each case one surge arrester protects a twin wire.

In one further, preferred embodiment, the ground contact is in the form of a twin fork contact, which is inserted from the front and is locked by means of the printed circuit board. Here too, the advantages of the fork contacts with respect to manufacturing tolerances of the grounding rail and the printed circuit board again come to bear.

The twin fork contact is preferably formed with an angled section. This makes it possible for one fork contact to make contact with the printed circuit board and the other fork contact, for the purpose of making contact with the grounding rail, to lie below the fork contacts of the connection contacts for the contact springs of the connection module. The ground contact in the form of a twin fork contact is in this case preferably inserted obliquely into an opening from the front and rotated. This takes place before the printed circuit board is inserted, this printed circuit board then locking the twin fork contact in the inserted state.

In one further, preferred embodiment, the housing of the protective plug is formed with a latching element, which fixes the printed circuit board.

In one further, preferred embodiment, the surge arrester is formed with a failsafe contact, such that, once an overvoltage has occurred, the twin wires are connected permanently to ground.

In one further, preferred embodiment, the protective plug comprises at least two surge arresters, which are arranged next to one another, said surge arresters being arranged such that they are offset with respect to one another in the longitudinal direction. When the printed circuit board has a narrow width, this makes it possible to ensure that the failsafe function is in no way impeded, in particular in the embodiment with a failsafe contact.

In one further, preferred embodiment, one ground contact is associated with each surge arrester. As a result, the ground currents are distributed evenly over the ground contacts, with the result that the necessary requirements as regards the current-carrying capacity of the individual contacts are not too stringent.

Figure 2:
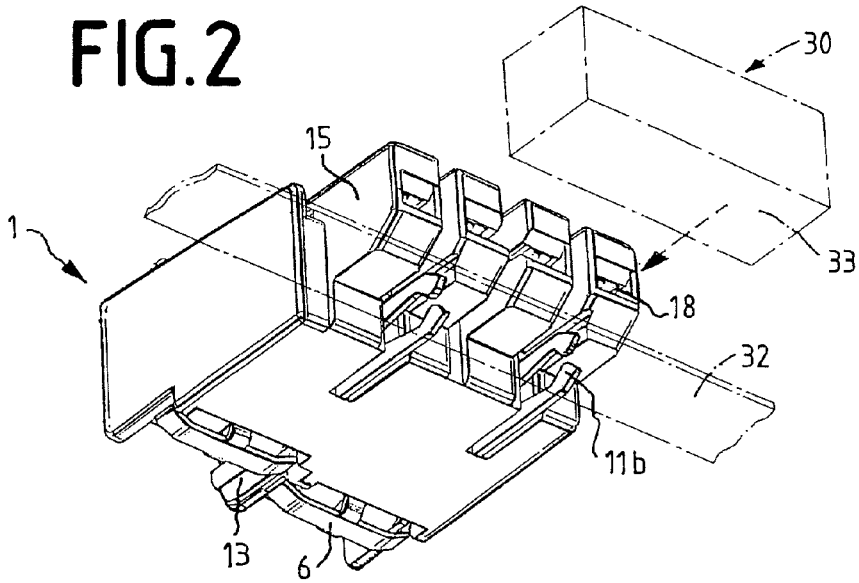
Figure 3:
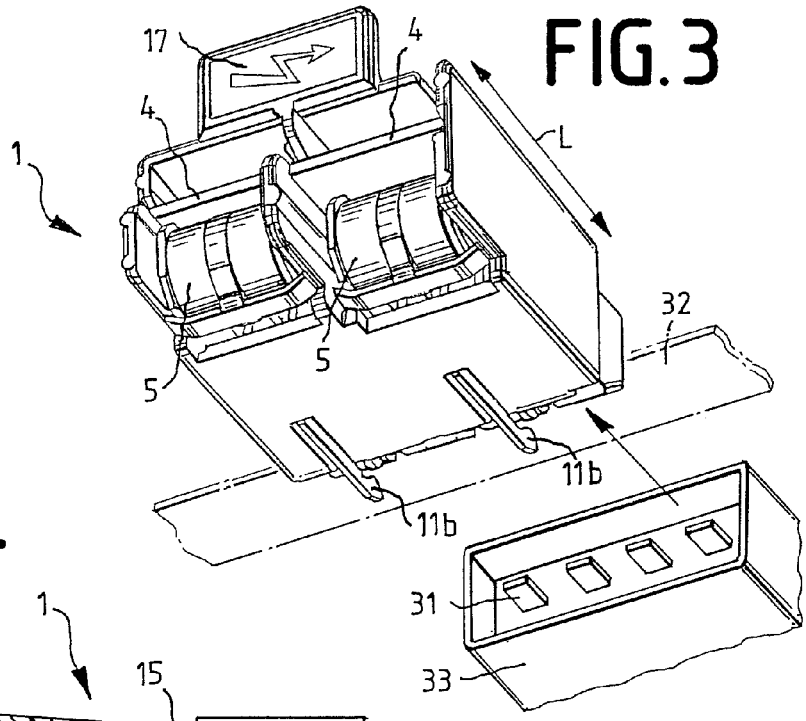
Figure 4:
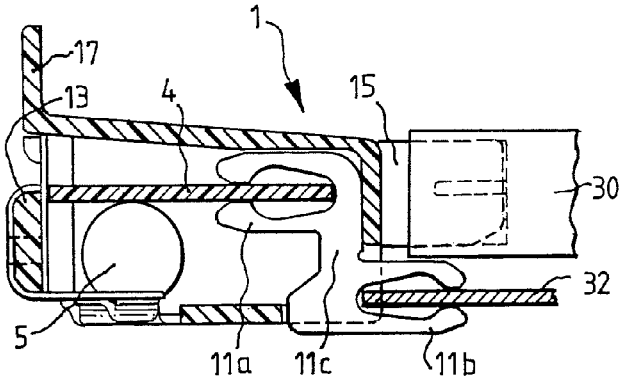

The invention will be explained in more detail below with reference to a preferred exemplary embodiment. In the figures:

FIG. 1 shows an exploded illustration of a protective plug for a connection module of a terminal distribution box, FIG. 2 shows a first perspective illustration of the assembled protective plug, FIG. 3 shows a second perspective illustration of the assembled protective plug, and FIG. 4 shows a sectional illustration of the protective plug.

FIG. 1 shows the protective plug 1 in an exploded illustration. The protective plug 1 comprises a housing 2, four twin fork contacts 3, two twin fork contacts 11 and a printed circuit board 4.

The housing 2 is preferably of integral design and is preferably made from plastic, further preferably from PC-ABS. Each of the four connection contacts in the form of twin fork contacts 3 has a fork contact 3*a*, 3*b* at its opposite ends. In this case, one fork contact 3*a* serves the purpose of making contact with a conductor track 4*a*, 4*c* on the printed circuit board 4, and the other fork contact 3*b* serves the purpose of making contact with a contact spring 31 of a connection module 30. A stop 3*c* is arranged between the two fork contacts 3*a*, 3*b*. A pair of in each case three conductor tracks 4*a*, 4*b*, 4*c*, which extend parallel next to one another, is arranged on the printed circuit board 4, said conductor tracks 4*a*, 4*b*, 4*c* being associated with a surge arrester 5 such that two three-pole surge arresters 5 with a failsafe contact 6 are arranged on the printed circuit board 4. The central conductor track 4*b* in this case makes contact with the central contact 7, and the outer conductor tracks 4*a*, 4*c* make contact with the outer electrodes 8, 9 of the surge arrester 5. Contact is made, for example, via a soldered connection. A failsafe contact 6 is formed in the region of the two outer electrodes 8, 9, said failsafe contact 6 having short-circuiting links 10 by means of which the two outer electrodes 8, 9 are short-circuited to the ground connection when a plastic film fuses. Furthermore, the protective plug 1 comprises two twin fork contacts 11, which each have fork contacts 11*a* and 11*b* at both opposite ends. The twin fork contacts 11 form the ground contacts of the protective plug 1. In this case, the fork contact 11*a* serves the purpose of making contact with the central conductor track 4*b* on the printed circuit board 4 in order to produce an electrical connection to the central contact 7 of the surge arrester 5. The fork contact 11*b* serves the purpose of making contact with a metallic grounding rail 32. The two fork contacts 11*a*, 11*b* are connected to one another via an angled section 11*c*.

The housing 2 comprises a partition wall 13, at whose lower end a latching element 14 is arranged on the rear 19 of the housing 2. Furthermore, the housing 2 comprises four rib-shaped elements 15, two opening slots 16 and a plate 17.

In order to mount the protective plug 1, initially the four twin fork contacts 3 are inserted into the housing 2 from the rear 19. In this case, the housing 2 is preferably structured such that chamber-like regions are formed, into which the twin fork contacts 3 can be inserted. The twin fork contacts 3 then abut a stop edge in the housing 2 with the stop 3*c*. Subsequently, the two twin fork contacts 11 on the front 20 are plugged into the two opening slots 16 from above at an angle and are rotated downwards. As the last step, the printed circuit board 4 is then inserted into the housing 2 from the rear 19. In this case, the fork contacts 3*a*, 11*a* are pushed over the printed circuit board 4 and make contact with the conductor tracks 4*a*, 4*b*, 4*c* arranged on the upper side and/or underside of the printed circuit board 4. In the completely inserted state, the latching element 14 latches behind the printed circuit board 4 and fixes it. The printed circuit board 4, on the other hand, fixes or locks the twin fork contacts 3, 11.

The contact springs 31 are connected to connection contacts (not illustrated) of the connection module 30. In this case, the connection contacts are preferably in the form of insulation displacement contacts. In the example illustrated, the connection module 30 would have 2×4 connection contacts in order to connect in each case two twin wires on the system side and the subscriber side, in each case one connection contact associated with the system side being arranged with one connection contact of the subscriber side. The connection contacts are in this case preferably accessible from the upper side opposite the underside 33.

FIG. 2 illustrates the protective plug 1 in the assembled state. In this case, it can further be seen that the rib-shaped elements 15 have openings 18, which the contact springs 31 of the connection module 30 can enter, and are surrounded on both sides by the fork contacts 3*b* from above and below, as a result of which a very robust electrical connection is produced. It can further be seen that the fork contacts 11*b* lie below the fork contacts 3*b* in order thus to make contact with the grounding rail 32 arranged below the connection module 30.

FIG. 3 illustrates the protective plug 1 in a perspective rear view. In this case, it can be seen, in particular, that the two surge arresters 5 are arranged next to one another, but offset in the longitudinal direction L of the housing 2, in order to ensure that there is a sufficient distance between the failsafe contacts 6. The protective plug 1 can be withdrawn easily with the aid of a screwdriver via the plate 17 when said protective plug 1 is connected to the connection module.

Finally, FIG. 4 shows the protective plug 1 in a sectional illustration, the section line extending through a twin fork contact 11.

LIST OF REFERENCES

1 Protective plug
2 Housing
3 Twin fork contact
3*a* Fork contact
3*b* Fork contact
3*c* Stop
4 Printed circuit board
4*a* Outer conductor track
4*b* Central conductor track
4*c* Outer conductor track
5 Surge arrester
6 Failsafe contact
7 Contact
8 Electrode
9 Electrode
10 Short-circuiting link
11 Twin fork contact
11*a* Fork contact
11*b* Fork contact
11*c* Angled section
13 Partition wall
14 Latching element
15 Rib-shaped element
16 Opening slot
17 Plate
18 Opening
19 Rear
20 Front
30 Connection module
31 Contact spring
32 Grounding rail
33 Underside
L Longitudinal direction

The invention claimed is:

1. A protective plug for a connection module, comprising:

at least one surge arrester, a housing within which the surge arrester is mounted, at least two connection contacts mounted in the housing, and at least one ground contact mounted in the housing, wherein, via the connection contacts, the surge arrester is connected to planar connection contacts of a connection module at a front of the housing, and wherein, via the ground contact, an electrical connection is produced between the surge arrester and a grounding rail arranged below the connection module, wherein the surge arrester is arranged on a printed circuit board, and wherein the connection contacts are in the form of twin fork contacts, each twin fork contact having a first fork that connects to the printed circuit board and a second fork that connects to one of the planar connection contacts of the connection module, the twin fork contacts being formed with a stop, which stops at a stop edge in the housing.

2. The protective plug as claimed in claim 1, wherein the connection contacts and the printed circuit board are inserted from a rear of the housing.

3. The protective plug as claimed in claim 1, wherein the ground contact is in the form of a twin fork contact, which is inserted into the housing from the front and is locked by the printed circuit board, each twin fork ground contact including a first grounding fork that connects to a first planar element and a second grounding fork that connects to a second planar element.

4. The protective plug as claimed in claim 3, wherein the twin fork ground contact is formed with an angled section.

5. The protective plug as claimed in claim 1, wherein the housing is formed with a latching element, which fixes the printed circuit board.

6. The protective plug as claimed in claim 1, wherein the surge arrester is formed with a failsafe contact.

7. The protective plug as claimed in claim 1, wherein the protective plug comprises at least two surge arresters, which are arranged next to one another, said surge arresters being arranged such that they are offset with respect to one another in a longitudinal direction extending from the front toward an opposite rear of the housing.

8. The protective plug as claimed in claim 1, wherein the first and second forks of each twin fork contact extends along a common axis with each other.

9. A protective plug for a connection module, comprising:

a housing having a front and a rear and including a stop edge;

a printed circuit board mounted to the housing;

at least one surge arrester arranged on the printed circuit board;

at least one twin fork contact mounted within the housing, the twin fork contact including a first fork contact extending in a first direction, a second fork contact extending in a second direction, and a stop, the second fork contact extending along a common axis with the first fork contact, the first fork contact being configured to engage the printed circuit board, the second fork contact being configured to engage a planar connection member to electrically connect the planar connection member and the surge arrester, and the stop being configured to abut the stop edge of the housing; and at least one ground contact engaging the printed circuit board, the ground contact being configured to electrically connect the surge arrester and a grounding rail.

10. The protective plug as claimed in claim 9, wherein the ground contact includes a first fork contact extending in the first direction and a second fork contact extending in the second direction.

11. The protective plug as claimed in claim 10, wherein the ground contact also includes an angled section extending between the first and second fork contacts of the ground contact.

12. The protective plug as claimed in claim 10, wherein the first fork contact of the ground contact engages the printed circuit board and the second fork contact of the ground contact engages a planar portion of the grounding rail.

13. The protective plug as claimed in claim 9, wherein the connection member includes a spring contact that is electrically connected to an insulation displacement contact.

14. The protective plug as claimed in claim 9, wherein the printed circuit board is slid within an interior of the housing from the rear of the housing.

15. The protective plug as claimed in claim 9, further comprising:

a second twin fork contact mounted within the housing, the second twin fork contact including a first fork contact extending in the first direction, a second fork contact extending in the second direction, and a stop, the first fork contact of the second twin fork contact being configured to engage the printed circuit board, the second fork contact of the second twin fork contact being configured to engage a second planar connection member to electrically connect the second planar connection members and the surge arrester, wherein the stop of the second twin fork contact is configured to abut the stop edge of the housing.

16. The protective plug as claimed in claim 15, further comprising:

a second surge arrester arranged on the printed circuit board;

at least two twin fork contacts mounted within the housing to engage the printed circuit board, each of the twin fork contacts being configured to electrically connect additional planar connection members and the second surge arrester; and a second ground contact engaging the printed circuit board, the second ground contact being configured to electrically connect the second surge arrester and the grounding rail.

17. The protective plug as claimed in claim 16, which the surge arresters are arranged on the printed circuit board so as to be offset with respect to each other in a longitudinal direction that extends from the front toward the rear of the housing.

18. The protective plug as claimed in claim 9, wherein the housing defines slots through which the ground contact can be inserted into the housing to engage the printed circuit board.

19. A protective plug for a connection module, comprising:

a housing having a front and a rear and including a stop edge;

a printed circuit board mounted to the housing;

at least one surge arrester arranged on the printed circuit board;

at least one twin fork contact mounted within the housing, the twin fork contact including a first fork contact extending in a first direction, a second fork contact extending in a second direction, and a stop, the first fork contact being configured to engage the printed circuit board, the second fork contact being configured to engage a planar connection member to electrically connect the planar connection member and the surge arrester, and the stop being configured to abut the stop edge of the housing; and at least one ground contact engaging the printed circuit board to electrically connect the surge arrester to a grounding rail, the ground contact including at least a first grounding fork that extends parallel to the first fork contact of the twin fork contact.

* * * * *